US008360016B2

(12) United States Patent
Wada et al.

(10) Patent No.: US 8,360,016 B2
(45) Date of Patent: Jan. 29, 2013

(54) ENGINE BLOWER

(75) Inventors: Shinichi Wada, Kawagoe (JP); Ryouji Zama, Kawagoe (JP)

(73) Assignee: Husqvarna Zenoah Co., Ltd., Kawagoe-Shi (JP)

( * ) Notice: Subject to any disclaimer, the term of this patent is extended or adjusted under 35 U.S.C. 154(b) by 742 days.

(21) Appl. No.: 12/376,561

(22) PCT Filed: Aug. 7, 2007

(86) PCT No.: PCT/JP2007/065444

§ 371 (c)(1),
(2), (4) Date: Feb. 5, 2009

(87) PCT Pub. No.: WO2008/018458

PCT Pub. Date: Feb. 14, 2008

(65) Prior Publication Data

US 2010/0186688 A1 Jul. 29, 2010

(30) Foreign Application Priority Data

Aug. 8, 2006 (JP) ..... 2006-215583

(51) Int. Cl.
*F01P 1/02* (2006.01)
*F01P 7/04* (2006.01)

(52) U.S. Cl. ..... 123/41.7; 123/41.65; 123/41.63; 123/41.49

(58) Field of Classification Search ..... 123/149 D, 123/41.65, 54.8, 392, 41.13, 198 E, 195 R, 123/179.1, 41.7, 41.56; 181/229, 238; 417/364
See application file for complete search history.

(56) References Cited

U.S. PATENT DOCUMENTS

| | | | | |
|---|---|---|---|---|
| 4,644,606 | A | 2/1987 | Luerken et al. | |
| 4,723,893 | A | 2/1988 | Kiyooka et al. | |
| 5,035,586 | A | 7/1991 | Sadler et al. | |
| 5,317,997 | A * | 6/1994 | Tomitaku | 123/41.7 |
| 2006/0185628 | A1 * | 8/2006 | Akaike et al. | 123/41.65 |

FOREIGN PATENT DOCUMENTS

| | | | |
|---|---|---|---|
| JP | 58-32186 | U | 3/1983 |
| JP | 61-283795 | A | 12/1986 |
| JP | 62-16110 | U | 1/1987 |
| JP | 8-218868 | A | 8/1996 |
| JP | 11-148122 | | 6/1999 |
| JP | 2000-170689 | A | 6/2000 |
| JP | 2005-090435 | A | 4/2005 |

(Continued)

OTHER PUBLICATIONS

English Language International Search Report dated Sep. 18, 2007 issued in parent Appln. No. PCT/JP2007/065444.

(Continued)

*Primary Examiner* — Nathaniel Wiehe
*Assistant Examiner* — Tea Holbrook
(74) *Attorney, Agent, or Firm* — Holtz, Holtz, Goodman & Chick, PC

(57) ABSTRACT

An engine blower includes a blower having a fan accommodated in a volute case, and an engine having a volute for generating a cooling air for self-cooling. An output shaft of the engine is provided with the fan without attaching a cooling fan for generating the cooling air. An outlet port for delivering a part of a blowing air generated by the fan is provided on the volute case.

2 Claims, 4 Drawing Sheets

FOREIGN PATENT DOCUMENTS

JP 3778269 A 10/2006

OTHER PUBLICATIONS

Japanese Office Action dated Feb. 15, 2011 (and English translation thereof) in counterpart Japanese Application No. 2006-215583.

English language International Preliminary Report on Patentability and Written Opinion of the International Searching Authority (7 pages), dated Feb. 19, 2009, issued in counterpart International Application No. PCT/JP2007/065444.

* cited by examiner

ENGINE BLOWER

This application is a U.S. National Phase Application under 35 USC 371 of International Application PCT/JP2007/065444 filed Aug. 7, 2007.

TECHNICAL FIELD

The present invention relates to an engine blower, specifically to an engine blower in which an all-purpose engine is installed.

BACKGROUND ART

Engine blowers for blowing and collecting fallen leaves as well as pruned branches and leaves have been known. In the engine blower, a fan accommodated in a volute case is rotated by an air-cooling engine. A portion of blowing air generated by a fan is employed as cooling air for cooling the engine. In other words, an outlet port is provided on a volute case, and a part of blowing air is delivered through the outlet port to the engine as the cooling air (e.g., Patent Document 1).

Patent Document 1: JP-B-3778269

DISCLOSURE OF THE INVENTION

Problems to be Solved by the Invention

Though such an air-cooling engine is often dedicatedly designed for an engine blower, it is favorable for reducing designing effort to install an all-purpose engine in an engine blower.

However, a cooling fan for self-cooling is usually equipped to an output shaft of an all-purpose engine in a manner accommodated in a volute of a crankcase, the crankcase being provided with an inlet port for introducing cooling air. When an all-purpose engine is used in an engine blower without a suitable modification, rotating sound of the cooling fan is leaked to an outside to hinder sound reduction.

An object of the present invention is to provide an engine blower that can reduce designing effort and noise leakage.

Means for Solving the Problems

An engine blower according to an aspect of the invention includes: a blower including a fan accommodated in a volute case; and an engine that drives the fan and includes a volute for generating cooling air, the cooling air cooling the engine, in which an output shaft of the engine is provided with the fan but not with a cooling fan that generates the cooling air, and the volute case is provided with an outlet port for delivering a part of blowing air generated by the fan toward the engine.

Here, "generating cooling air, the cooling air cooling the engine" refers to a case in which a cooling fan is hypothetically attached to the output shaft of the engine.

With this aspect of the invention, since an all-purpose engine including a volute for generating cooling air for self-cooling is employed as an engine installed in the engine blower, it is not necessary to newly design a dedicated engine, so that effort of designing an engine can be reduced. In addition, whereas a cooling fan is attached according to a specification of an all-purpose engine, this cooling fan is omitted in the engine blower according to the aspect of the invention, thus omitting rotating sound of the cooling fan to reliably achieve noise reduction. Thus, the above-noted object of the invention can be achieved. Incidentally, a part of blowing air is delivered through the outlet port of the volute case as cooling air, which cools the engine.

A cooling fan for self-cooling is usually attached on an output shaft of an all-purpose engine, and a magneto magnet is buried in this cooling fan. In the aspect of the invention where the cooling fan is omitted, a disc-shaped rotor, for example, is provided instead of the cooling fan and the magnet is buried in the rotor. On the other hand, since the crankcase of the engine is provided with the volute, a coil that generates electromotive force when the magnet passes is provided at an upper side of the volute at a position properly corresponding to the cylinder. In this case, depending on positioning of the coil, cooling air from the outlet port may be interfered so that the cooling air is not favorably delivered to the cylinder.

In the engine blower according to the above aspect, a magneto coil is preferably positioned between a cylinder of the engine and the volute case, and the outlet port is preferably provided at a position misaligned relative to a position of the coil of the volute case.

With this arrangement, the outlet port is positioned so that interference due to the coil is reduced. Accordingly, the cooling air from the outlet port can reliably be delivered to the cylinder to further effectively cool the engine.

In the engine blower according to the above aspect, it is preferable that the volute is integrated with a crankcase of the engine, the crankcase is provided with an inlet port for introducing the cooling air for self-cooling; and the inlet port is covered with a casing cover.

Again, "introducing cooling air, the cooling air cooling the engine" refers to a case in which a cooling fan is hypothetically attached to the output shaft of the engine.

With this arrangement, the inlet port, which is typically provided to all-purpose engines on crankcases thereof, is covered with a casing cover, so that sound leakage through the inlet port can reliably be blocked, thus achieving further noise reduction.

An embodiment of the invention will be described below with reference to the drawings.

Figure 1:
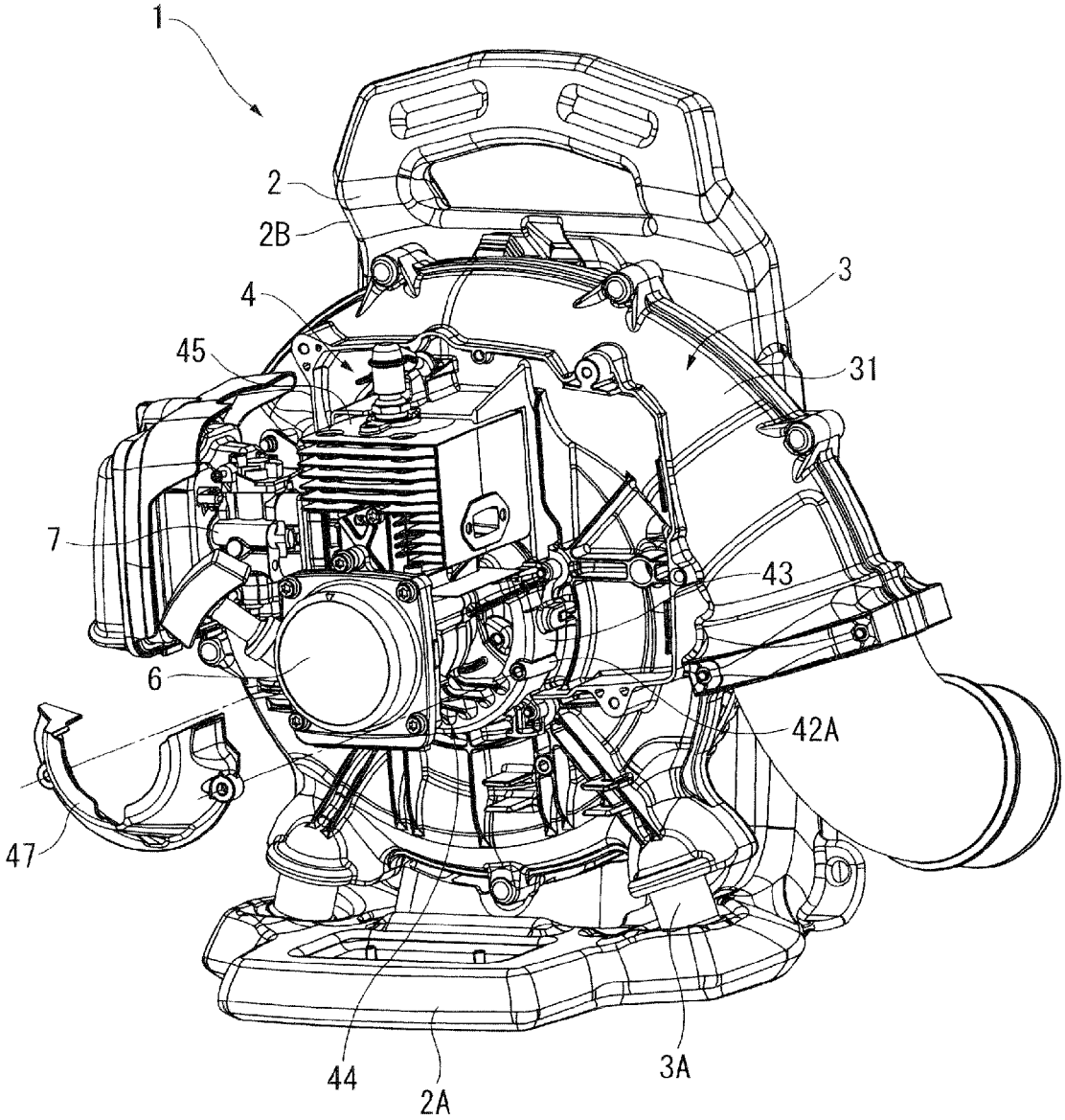
FIG. 1 is a perspective view showing a partial explosion of an engine blower according to an embodiment of the invention.
Figure 2:
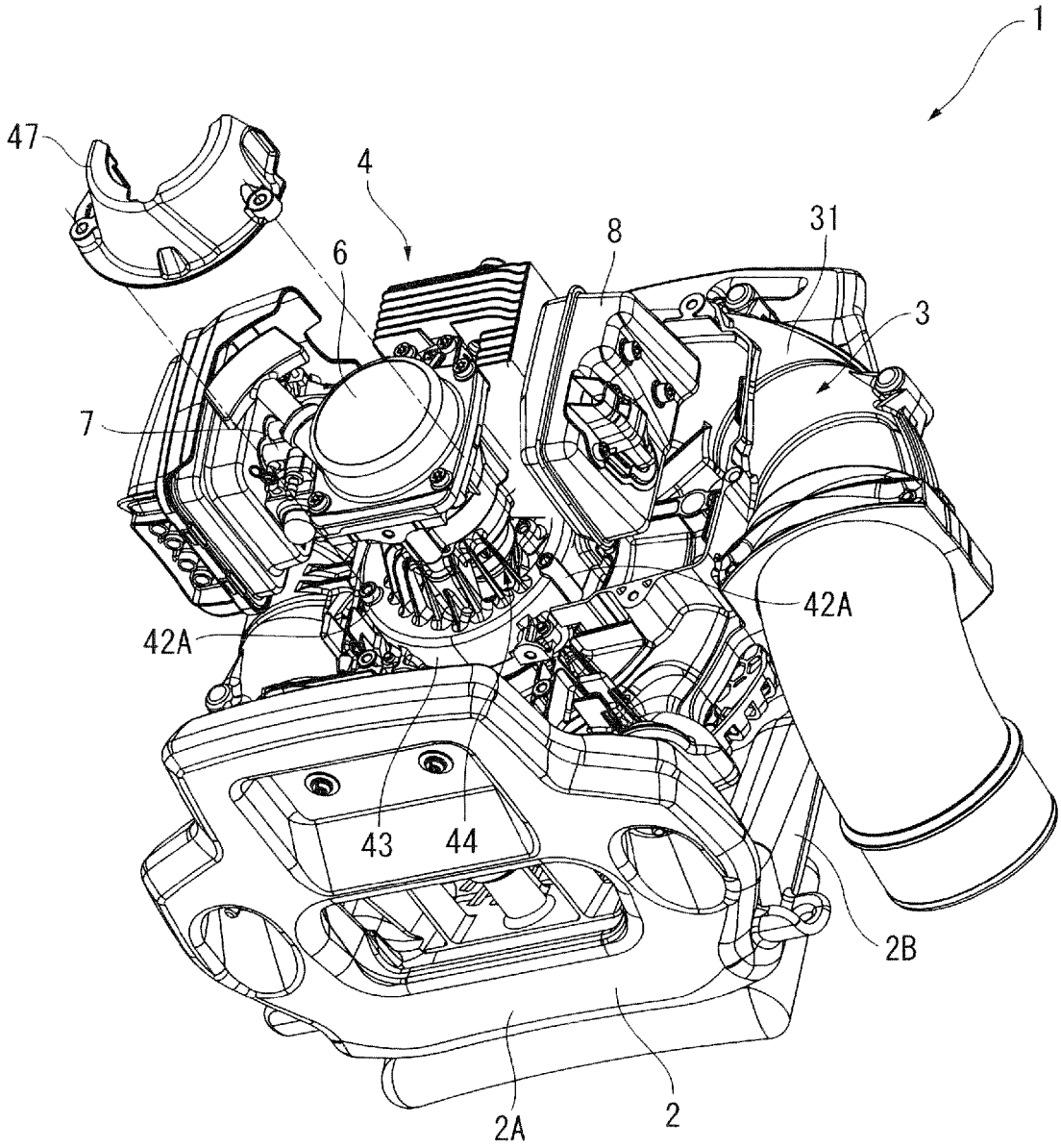
FIG. 2 is another perspective view of the engine blower diagonally viewed from a lower side.
Figure 3:
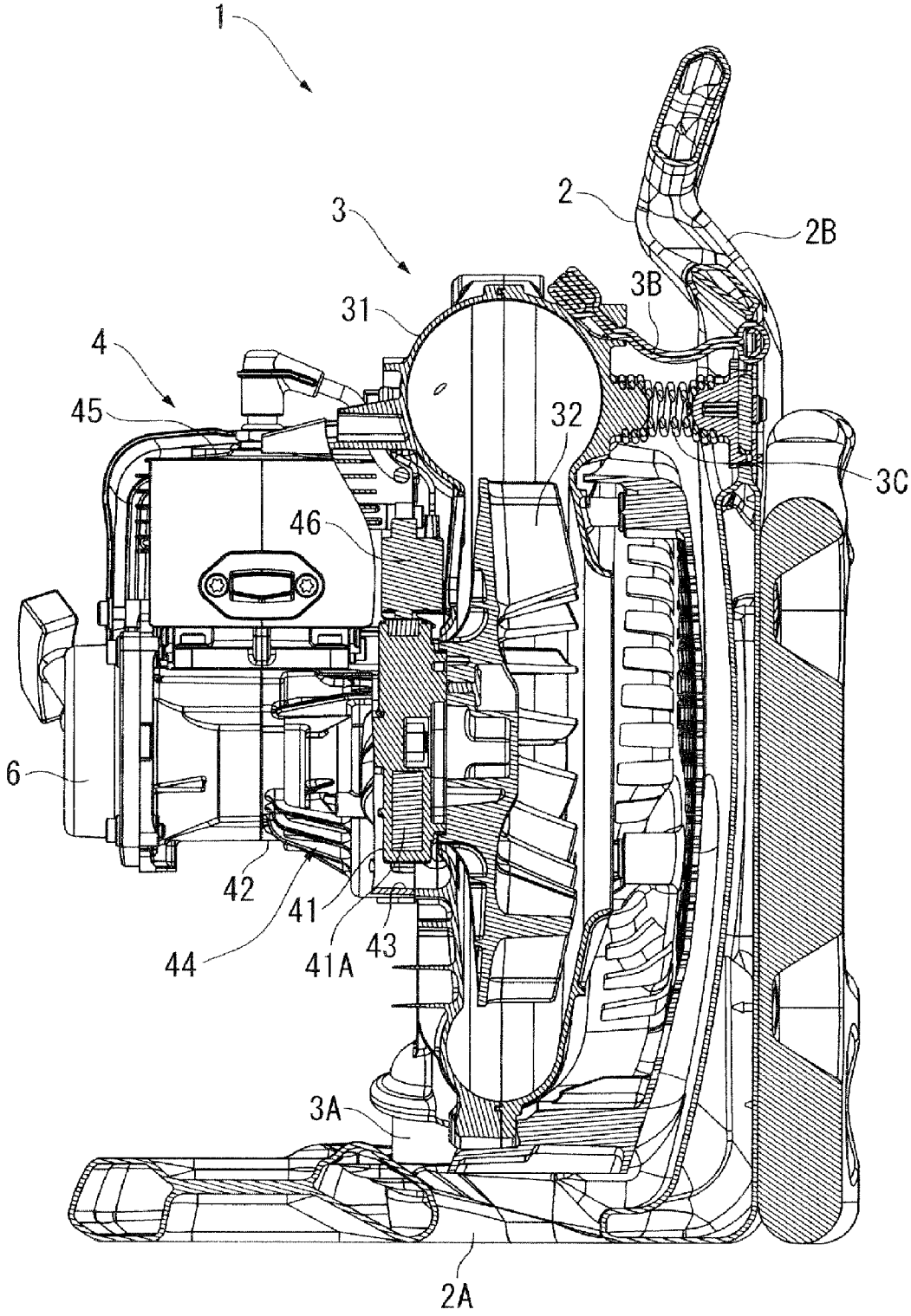
FIG. 3 shows a vertical cross section of the engine blower.
Figure 4:
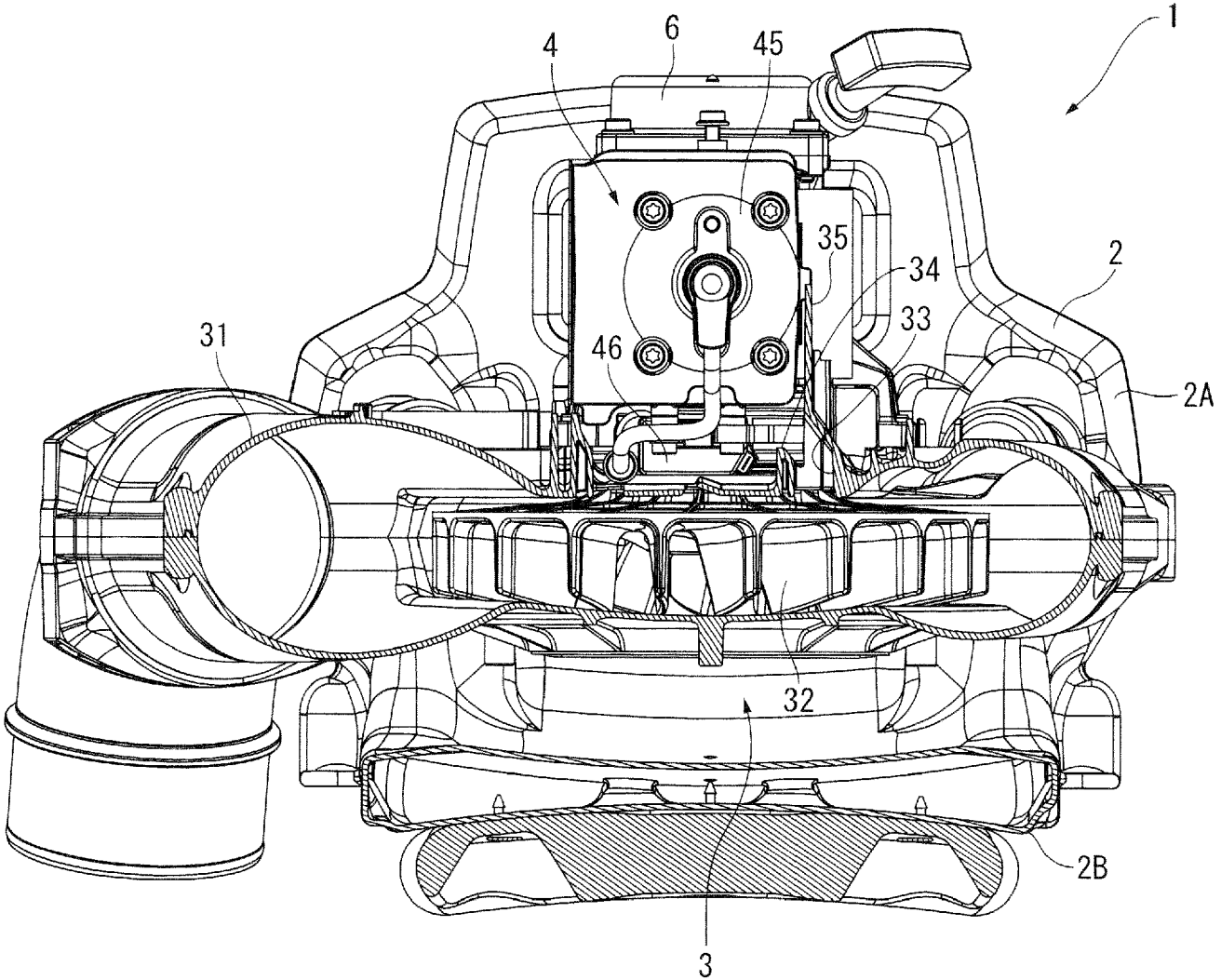
FIG. 4 shows a plan cross section of a primary portion of the engine blower.

FIG. 1 is a perspective view showing a partial explosion of an engine blower 1 according to the embodiment. FIG. 2 is another perspective view of the engine blower 1 diagonally viewed from a lower side. FIG. 3 shows a vertical cross section of the engine blower 1. FIG. 4 shows a plan cross section of a primary portion of the engine blower 1.

In FIGS. 1 and 2, the engine blower 1 includes an L-shaped frame 2 made of synthetic resin having a horizontal mounting portion 2A and a vertical back support 2B, and a blower 3 is supported via rubber mounts 3A at two positions on the right and left sides of the mounting portion 2A. The blower 3 is also connected to the back support 2B via a belt-shaped connector 3B (see FIG. 3) and a coil spring 3C (see FIG. 3).

A fuel tank (not shown) is also mounted on the mounting portion 2A, from which fuel is supplied to an air-cooling engine 4 attached in front of a volute case 31 of the blower 3. The engine 4 rotates a fan 32 (see FIGS. 3 and 4) accommodated in the volute case 31. Blowing air generated by the rotation of the fan 32 is ejected from a nozzle provided at an end of an air pipe connected to the volute case 31.

The engine 4 is started by a cranking operation on a recoil starter 6. The engine 4 includes: a carburetor 7 that produces air-fuel mixture of the fuel from the fuel tank and intake air; and a muffler 8 (see FIG. 2) that exhausts exhaust gas while deadening engine sound. The engine 4 is usually covered by an engine cover screwed to the volute case 31, though the engine cover is not shown in the embodiment.

The engine 4 of the embodiment, which is an all-purpose engine also used in other portable work machines such as a lawn mower, is used without a cooling fan for self-cooling that is common in specifications of all-purpose engines. As a result, engine designing dedicated for the engine blower 1 can be omitted to simplify engine designing.

Accordingly, a first end of an output shaft (crankshaft) of the engine 4 is provided with the above-noted recoil starter 6, while a second end thereof is not provided with a cooling fan. However, as shown in FIG. 3, the second end of the output shaft is provided with a rotor 41 instead of a cooling fan. The fan 32 is provided at an outer side of the rotor 41, a magneto magnet 41A being buried in the rotor 41 itself.

Since the engine 4 is an all-purpose engine, the rotor 41 is accommodated in a volute 43 integrated with a crankcase 42. The volute 43, which is inherently a portion that functions when the cooling fan is attached to the engine 4, is provided to blow cooling air swallowed through an inlet port 44 of the crankcase 42 toward a cylinder 45.

In other words, in the embodiment where an all-purposed engine is employed without significant modification, the crankcase 42 of the engine 4 is still provided with the volute 43, and a magneto coil 46 is positioned above the volute 43 in a manner interposed between the cylinder 45 and the volute case 31. Such positioning of the coil 46 is based on the typical specification of an all-purpose engine.

Furthermore, in the engine 4 where a cooling fan is not employed, the inlet port 44 of the crankcase 42 is covered with a metallic casing cover 47 (see FIGS. 1 and 2). Accordingly, the crankcase 42 is provided with a pair of attaching portions 42A for screwing the casing cover 47.

In addition, according to the structure employed in the embodiment, since the engine 4 is not provided with a cooling fan, a part of blowing air generated in the blower 3 is used as cooling air for the engine 4. With this structure, rotating sound of the cooling fan can prevented from leaking out of the inlet port 44, so that noise reduction can be facilitated while the engine 4 is favorably cooled. Moreover, as described above, since the inlet port 44 itself is covered with the casing cover 47, even the rotating sound of the rotor 41 is reliably prevented from leaking, thereby achieving further noise reduction. A cooling structure of the engine 4 will be described below in detail.

In the volute case 31 as shown in FIG. 4, an outlet port 33 for delivering a part of blowing air in the volute case 31 to the engine 4 as cooling air is provided at a position displaced relative to the magneto coil 46 toward the right side in the figure (i.e. a position greatly displaced from the rotating center of the fan 32 obliquely leftward and upward when viewed from the engine 4 in a front elevation). Since the coil 46 is positioned between the cylinder 45 and the volute case 31, it is necessary to prevent unfavorable interference of the coil 46 when the cooling air is delivered to the cylinder 45. Thus, the outlet port 33 is misaligned with respect to the coil 46.

In addition, a guide 34 is provided around the outlet port 33 for guiding the cooling air to a corner of the cylinder 45 formed rectangular in plan view. The guide 34 allows the cooling air to be supplied to entire surroundings of the cylinder 45 from the corner of the cylinder 45 which is secluded from the coil 46, so that the cylinder 45 can be effectively cooled.

More specifically, an extending piece 35 extending to a left side of the cylinder 45 is provided to a part of the guide 34, so that the cooling air does not flow to an outside immediately after being delivered through the outlet port 33, thereby allowing efficient utilization of the cooling air. Incidentally, though the carburetor 7, the muffler 8, and the engine cover are not shown in FIG. 4, the cooling air is discharged to an outside through a large number of discharge slits provided on the engine cover after cooling the cylinder 45 in the engine cover.

It should be noted that, though the best structure, method and the like for implementing the invention have been disclosed in the above description, the invention is not limited to the above description. In other words, though the invention is particularly illustrated and described in the specific embodiment, the skilled person in the art can modify the above-described shapes, quantities and other details without departing from the technical idea and the scope of the invention.

The above disclosure limiting the shapes, amounts, and the like are merely exemplary statements for facilitation of the understanding of the invention and do not limit the scope of the invention. Statements of members without part of or all of the limitations on the shapes, amounts, and the like are within the scope of the invention.

For example, though the casing cover 47 for covering the inlet port 44 is attached to the crankcase 42 in the above embodiment, the casing cover 47 may be attached to the volute case 31.

In addition, since the engine 4 is not provided with a cooling fan for self-cooling and thus noise is significantly reduced, the casing cover 47 may be used if necessary and may be omitted. However, when the casing cover 47 is provided, even the rotating sound of the rotor 41 can be prevented from leaking, and such further facilitation of noise reduction is favorable. Also, when the casing cover 47 is provided, the cooling air from the outlet port 33 is prevented from being delivered to and discharged through the inlet port 44 at a lower side, thereby allowing the upper side of the cylinder 45 to be further effectively cooled.

The invention claimed is:

1. An engine blower comprising:

a blower including a volute case having a space for generating blowing air, and a fan accommodated in the space of the volute case, the space being connected to an air pipe for ejecting the blowing air; and an engine that drives the fan and includes a volute, wherein the engine does not have a cooling fan for cooling the engine provided in the volute, wherein an output shaft of the engine is coupled to the fan of the blower;

wherein the volute case is provided with an outlet port which delivers blowing air generated by the fan from the space of the volute case toward the engine;

a magneto coil is positioned between a cylinder of the engine and the volute case; and, the outlet port is provided at a position misaligned relative to a position of the coil.

2. The engine blower according to claim 1, wherein:

the volute is integrated with a crankcase of the engine, the crankcase is provided with an inlet port for introducing the blowing air delivered from the blower, and the inlet port is covered with a casing cover.

* * * * *